United States Patent [19]

Kawai et al.

[11] 4,204,505

[45] May 27, 1980

[54] BASIC AIR-FUEL RATIO ADJUSTMENT METHOD AND APPARATUS

[75] Inventors: Mitsuo Kawai, Okazaki; Hironobu Ono, Toyota, both of Japan

[73] Assignee: Toyota Jidosha Kogyo Kabushiki Kaisha, Toyota, Japan

[21] Appl. No.: 929,718

[22] Filed: Jul. 31, 1978

[30] Foreign Application Priority Data

Nov. 14, 1977 [JP] Japan ..... 52-135619

[51] Int. Cl.[2] ..... F02B 3/00

[52] U.S. Cl. ..... 123/119 EC; 60/276; 123/32 EE

[58] Field of Search ..... 123/119 EC, 32 EE, 32 EA; 60/276, 285

[56] References Cited

U.S. PATENT DOCUMENTS

| | | | |
|---|---|---|---|
| 4,075,982 | 2/1978 | Asano et al. | 123/119 EC |
| 4,096,834 | 6/1978 | Norimatsu et al. | 123/32 EE |
| 4,106,450 | 8/1978 | Norimatsu et al. | 123/32 EE |
| 4,117,807 | 10/1978 | Barnard | 123/32 EE |
| 4,123,999 | 11/1978 | Asano | 123/32 EE |
| 4,130,095 | 12/1978 | Bowler et al. | 123/119 EC |

*Primary Examiner*—Charles J. Myhre
*Assistant Examiner*—Raymond A. Nelli
*Attorney, Agent, or Firm*—Stevens, Davis, Miller & Mosher

[57] ABSTRACT

Disclosed is a basic air-fuel ratio adjustment method and an apparatus for an internal combustion engine. The adjustment of the basic air-fuel ratio is performed by measuring a signal level corresponding to the level of an air-fuel ratio compensation signal of the engine while the feedback control operation for compensating an error of the air-fuel ratio of the engine is being stopped, by measuring the average level of the air-fuel ratio compensation signal when the feedback control is in operation, and by adjusting the means for presetting the basic air-fuel ratio of the air-fuel mixture fed into the engine so that the difference between the measured signal level and the measured average signal level becomes equal to a predetermined value. Thus, the adjustment of the basic air-fuel ratio can be very easily performed. Furthermore, a high accuracy of the adjustment can be easily obtained.

10 Claims, 4 Drawing Figures

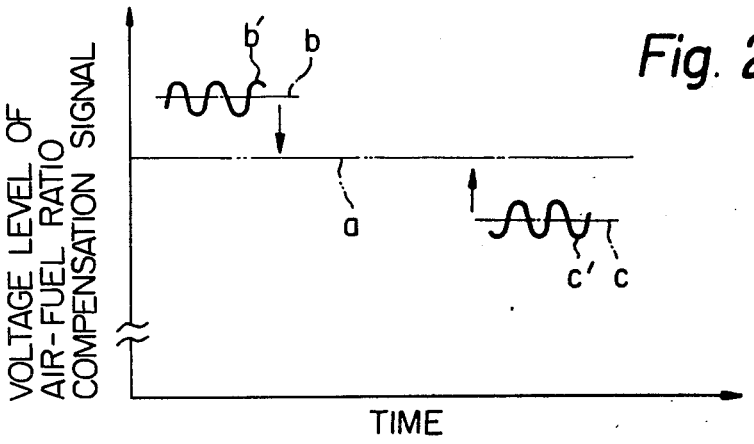
Fig. 2
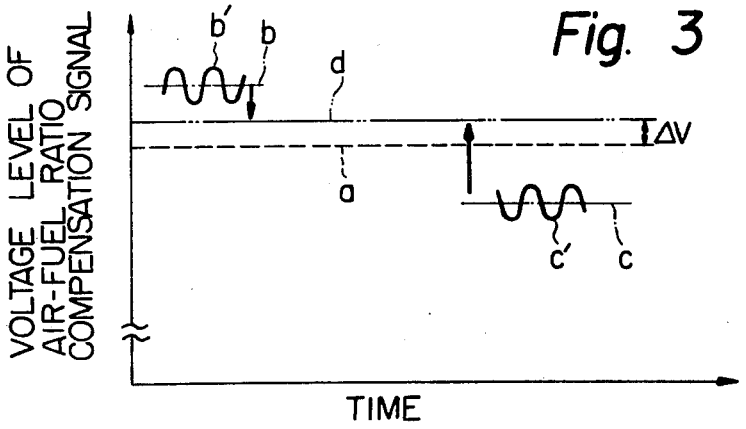
Fig. 3
Fig. 4
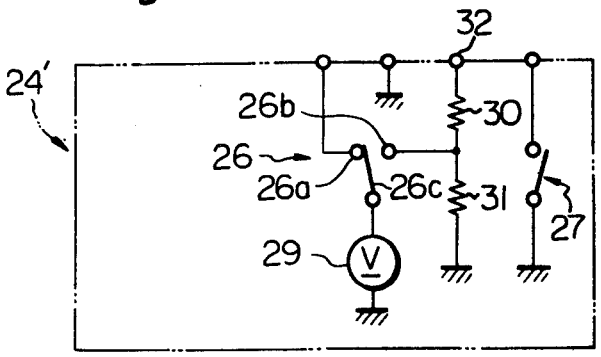

BASIC AIR-FUEL RATIO ADJUSTMENT METHOD AND APPARATUS

BACKGROUND OF THE INVENTION

The present invention relates to a basic air-fuel ratio adjustment method and an apparatus for an internal combustion engine. More particularly, the invention relates to a basic air-fuel ratio adjustment method and an apparatus for adjusting the basic air-fuel ratio of the engine of the air-fuel ratio feedback control type to a desired value.

There is known a system of performing feedback control for maintaining an equivalent air-fuel ratio (if an air-fuel passage from the intake passage through the exhaust passage located upstream of an air-fuel ratio sensor is defined as a working fluid passage, the equivalent air-fuel ratio is defined as a ratio of the amount of air fed into the working fluid passage to the amount of fuel fed into the working fluid passage) within a predetermined range by compensating an error of the equivalent air-fuel ratio in accordance with an air-fuel ratio compensation signal fed back from the air-fuel ratio sensor disposed in the exhaust passage. In these systems, the basic air-fuel ratio is always maintained at a predetermined value by an air-fuel mixture supplying mechanism such as a carburetor or a fuel injection mechanism disposed in an intake system of the engine. The compensation of the error of the equivalent air-fuel ratio is generally carried out by increasing or decreasing the amount of fuel injected into the intake passage by means of the fuel injection valve, or by increasing or decreasing the amount of secondary air fed into the exhaust passage by means of a secondary air feeding mechanism.

Since it is desirable that the error of the equivalent air-fuel ratio to be compensated be as small as possible, a correct adjustment of the basic air-fuel ratio of an internal combustion engine is required.

One method for adjusting the basic air-fuel ratio is that of using a direct measurement method, such as the method of obtaining the basic air-fuel ratio by directly measuring both the amount of air introduced into the engine and the amount of fuel fed into the engine. However, since this direct measurement method requires a special measuring apparatus, it is difficult to adjust the basic air-fuel ratio at an ordinary engine service shop by using such direct measurement method.

Another method for adjusting the basic air-fuel ratio is that of using a simple carbon monoxide concentration detector (hereinafter referred to as a CO meter) which is always available at an ordinary engine service shop. This adjustment method is based on the fact that the concentration of the CO formation in the exhaust gas of the engine is related to the basic air-fuel ratio of the engine when the basic air-fuel ratio is on the rich side of the stoichiometric air-fuel ratio. Therefore, the adjustment of the basic air-fuel ratio by using the CO meter is always carried out during the rich fuel condition. In order to create this condition, the air-fuel ratio of the air-fuel mixture is intentionally shifted from its original position to the rich side of the stoichiometric air-fuel ratio, and then the air-fuel ratio is returned to its original position after the adjustment is completed.

However, since the concentration of the CO formation in the exhaust gas emitted from the engine which is provided with a secondary air supplying system for automatically controlling the amount of secondary air supplied to the engine in accordance with the concentration of the $O_2$ formation in the exhaust gas and which is also provided with a catalytic converter having a good purifying efficiency, is extremely low even when the air-fuel ratio of the air-fuel mixture is on the rich side of the stoichiometric air-fuel ratio, the CO meter cannot be used for adjusting the basic air-fuel ratio.

Furthermore, in the latter method, since the air-fuel ratio of the air-fuel mixture is forcibly shifted to the rich fuel condition for adjusting the basic air-fuel ratio, the accuracy of the adjustment is not satisfactory. Therefore, by using this latter method, a large amount of harmful pollutants is sometimes emitted from the engine, and the operating characteristics of the engine also become worse.

SUMMARY OF THE INVENTION

It is therefore an object of the present invention to provide a basic air-fuel ratio adjustment method and an apparatus for an internal combustion engine, whereby the adjusting operation of the basic air-fuel ratio can be easily performed.

Another object of the present invention is to provide a basic air-fuel ratio adjustment method and an apparatus for obtaining a highly accurate adjustment.

The basic air-fuel ratio adjustment method and the apparatus of the present invention are adapted for an internal combustion engine which has a means for presetting a basic air-fuel ratio of the air-fuel mixture fed into the engine and a means for compensating the error of the air-fuel ratio of the engine in accordance with an air-fuel ratio compensation signal which is fed back from an air-fuel ratio sensor mounted in an exhaust system of the engine.

According to the present invention, the basic air-fuel ratio adjustment method comprises the steps of: measuring a signal level corresponding to the level of the air-fuel ratio compensation signal while the above-mentioned feedback control operation of the means for compensating an error of the air-fuel ratio is being stopped; measuring the average level of the air-fuel ratio compensation signal while the above-mentioned feedback control operation is being carried out; and adjusting the means for presetting the basic air-fuel ratio of the air-fuel mixture so that the difference between the measured signal level and the measured average level of the air-fuel ratio compensation signal becomes equal to a predetermined value.

According to the present invention, the basic air-fuel ratio adjustment apparatus comprises a means for measuring a signal level corresponding to the level of the air-fuel ratio compensation signal while the above-mentioned feedback control operation of the means for compensating an error of the air-fuel ratio is being stopped, and a means for measuring the average level of the air-fuel ratio compensation signal while the above-mentioned feedback control operation is being carried out.

The above and other related objects and features of the present invention will be apparent from the following description of the present invention with reference to the accompanying drawings, as well as from the appended claims.

BRIEF DESCRIPTION OF THE DRAWINGS

FIGS. 2 and 3 are diagrams of the waveforms produced during the operation of the embodiment shown in FIG. 1; and FIG. 4 is a circuit diagram of another embodiment according to the present invention.

DETAILED DESCRIPTION OF THE INVENTION

Figure 1:
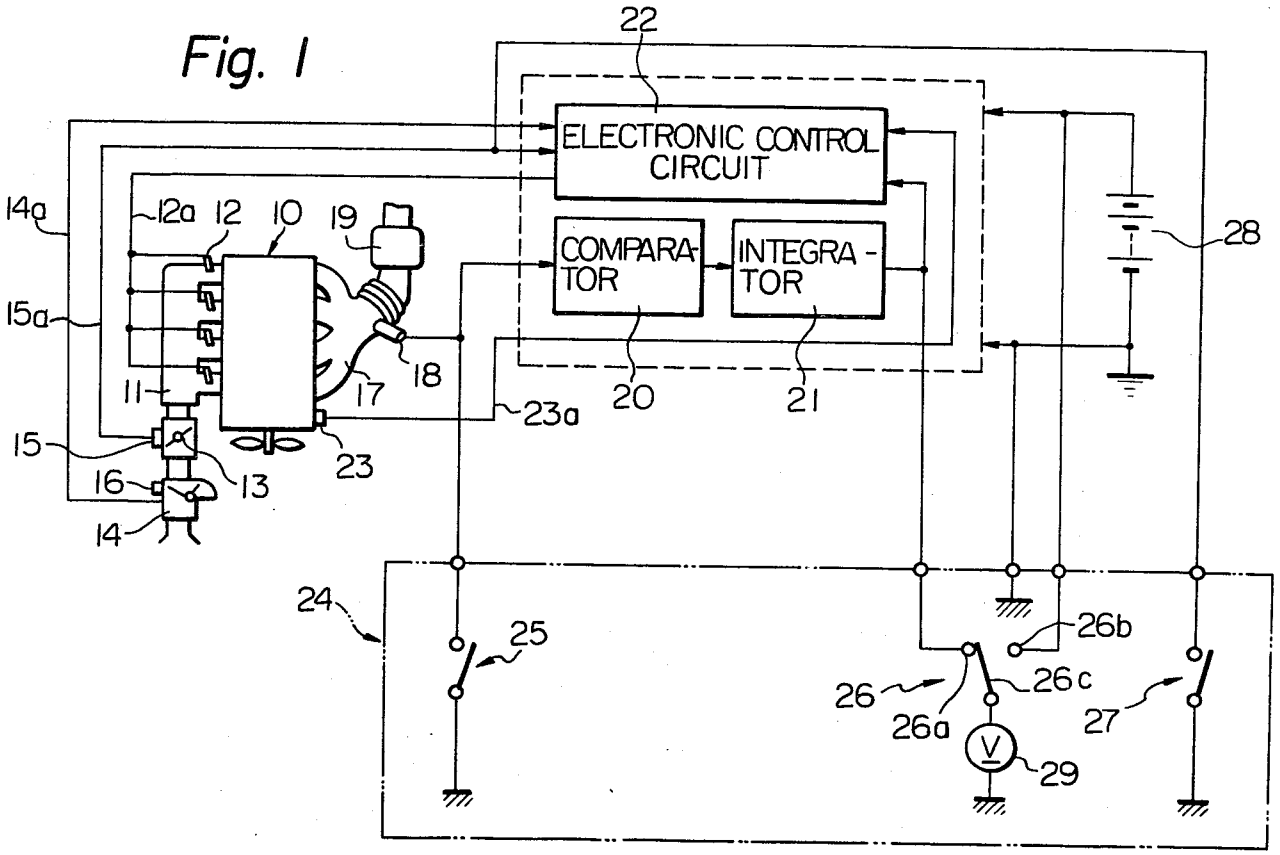
FIG. 1 is a schematic diagram of an embodiment according to the present invention.

FIG. 1 shows a schematic diagram of an embodiment according to the present invention. In this embodiment, a basic air-fuel ratio adjustment apparatus is adapted for an internal combustion engine having an electronic fuel injection control device (hereinafter referred to as an EFI device).

Referring to FIG. 1, reference numeral 10 shows an engine block. At least one fuel injection valve 12 is mounted on an intake manifold 11 of the engine 10. The fuel injection valve 12 is an on-off electro-magnetic valve which is controlled by pulse signals applied thereto. Fuel with a certain pressure level is fed from a fuel supply mechanism via a conduit (not shown in FIG. 1) to this fuel injection valve 12. The amount of fuel supplied to the engine is determined by the time duration of the pulse signal applied to the fuel injection valve 12 from an electronic control circuit 22 (described hereinafter) via a line 12*a*.

A throttle valve 13 and an air-flow sensor 14 are mounted on the intake system upstream of the intake manifold 11. A throttle position switch 15 is connected to the axle of the throttle valve 13. The throttle position switch 15 generates a high level signal when the throttle valve 13 is closed, and then feeds the high level signal to the electronic control circuit 22 via a line 15*a*. The air-flow sensor 14 detects the amount of air introduced into the engine, and feeds a signal which indicates the amount of the intake air flowing to the electronic control circuit 22 via a line 14*a*.

The air-flow sensor 14 is provided with a bypass passage (not shown) through which a part of the intake air can pass without detection, and a bypass screw 16 for adjusting the amount of the air flow passing through the bypass passage. Therefore, the amount of air introduced into the engine without being detected by the electronic control circuit 22 can be controlled by adjusting the bypass screw 16, and thereby the basic air-fuel ratio of the engine can be adjusted. In this embodiment, the bypass screw 16 is equivalent to the aforementioned means for presetting the basic air-fuel ratio of the air-fuel mixture fed into the engine.

An air-fuel ratio sensor 18 for detecting the equivalent air-fuel ratio is mounted on the exhaust system downstream of an exhaust manifold 17 of the engine. The air-fuel ratio sensor 18 of the embodiment is a well-known oxygen concentration sensor using zirconium oxide as an oxygen ion conductor. The sensor 18 generates an output voltage of about 1V when the air-fuel ratio is lower than the stoichiometric air-fuel ratio, namely, when the engine is maintained on the rich side of the stoichiometric conditions. Furthermore, the sensor 18 generates an output voltage of about 0.1 to 0.2V when the air-fuel ratio is higher than the stoichiometric air-fuel ratio, namely, the engine is maintained on the lean side of the stoichiometric conditions.

A three-way catalytic converter 19 for simultaneously reducing the three main pollutants in the exhaust gas, i.e., $NO_x$, CO and HC formations, is mounted in the exhaust system downstream of the air-fuel ratio sensor 18.

The output terminal of the air-fuel ratio sensor 18 is connected to the input terminal of a comparator 20. The output terminal of the comparator 20 is connected to the electronic control circuit 22 through an integrator 21. The comparator 20 and the integrator 21 form a feedback circuit for generating an air-fuel ratio compensation signal and for applying this signal to the electronic control circuit 22. When the engine is operating at the lean side of the stoichiometric conditions, the air-fuel ratio compensation signal is maintained at a level by which the amount of fuel injected into the engine via the fuel injection valve 12 is increased in comparison with the basic amount of the fuel to be supplied, which determines the basic air-fuel ratio. Contrary to this, when the engine is operating at the rich side, the air-fuel compensation signal is maintained at a level by which the amount of fuel injected into the engine via the valve 12 is decreased in comparison with the basic fuel supplying amount. Furthermore, when the engine is operating at stoichiometric conditions, the air-fuel ratio compensation signal is maintained at a level by which the basic amount of the fuel to be supplied is injected into the engine via the valve 12, namely, in this case, no compensation of the amount of fuel for injection based on the air-fuel ratio compensation signal is carried out.

When the high level signal which indicates the closing of the throttle valve 13 is applied from the throttle position switch 15, the above-mentioned feedback circuit stops its feedback operation.

A well-known detector 23 for detecting the rotational speed of the engine 10 is also connected via a line 23*a* to the electronic control circuit 22. This control circuit 22 calculates the basic amount of the fuel to be supplied, which causes the engine condition to be maintained on the basic air-fuel ratio, according to the intake air-flow amount signal fed from the air-flow sensor 14, according to the rotational speed signal fed from the detector 23 and according to the air-fuel ratio correcting signals fed from a coolant temperature sensor (not shown), an intake air temperature sensor (not shown), a throttle position sensor (not shown) and another sensors. Then the control circuit 22 corrects the calculated basic amount of the fuel to be supplied in accordance with the above-mentioned air-fuel ratio compensation signal. After that, the circuit 22 feeds pulse signals having a time duration corresponding to the calculated and compensated amount of fuel to be supplied to the fuel injection valve 12.

In FIG. 1, reference numeral 24 shows a basic air-fuel ratio adjustment device. The device 24 comprises a first switch 25, second switch 26, a third switch 27 and a voltage meter 29. The first switch 25 is connected between the output terminal of the air-fuel ratio sensor 18 and the earth. The second switch 26 has two fixed contacts 26*a* and 26*b* and a movable contact 26*c* which selectively meets one of the fixed contacts 26*a* and 26*b*. One fixed contact 26*a* is connected to the output terminal of the integrator 21, and the other fixed contact 26*b* is connected to the positive terminal of a battery 28 which supplies electrical power to each of the above-mentioned circuits (i.e., circuits enclosed by the broken line in FIG. 1) of the engine. The movable contact 26*c* is connected to one terminal of the voltage meter 29 of a direct current type. The other terminal of the meter 29 is grounded. The third switch 27 is connected between the output terminal of the throttle position switch 15 and the earth.

The basic air-fuel ratio adjusting procedure according to this embodiment will now be described.

The second switch 26 of the device 24 is first set to the fixed contact 26*a*. Then, during the feedback control operation of the air-fuel ratio based on the air-fuel ratio compensation signal being stopped, the voltage level of the air-fuel ratio compensation signal is measured by the voltage meter 29. In this case, if the feedback control is in operation, the first switch 25 of the device 24 should be closed so as to ground the output terminal of the air-fuel ratio sensor 18 to thereby cause the feedback control operation to stop as disclosed in the specification of the Japanese Patent Laid Open Publication No. Sho 51(1976)-54127.

After that, the first switch 25 is opened and the feedback control operation is thus started again. During this state, namely, while the feedback control is in operation, the bypass screw 16 is adjusted with measuring the voltage level of the air-fuel compensation signal by means of the meter 29 so that this measured voltage level becomes equal to the voltage level which is measured while the feedback control operation is stopped. In the case wherein the desired basic air-fuel ratio to be adjusted is different from the stoichiometric air-fuel ratio, the bypass screw 16 should be adjusted so that the difference between this measured voltage level and the measured voltage level is equal to a predetermined value.

It is advisable to check the voltage of the terminal of the battery 28 by switching the second switch 26 to the fixed contact 26*b* during this adjustment. If the voltage of the terminal of the battery 28 is different from the rated voltage of the battery 28, the voltage level of the air-fuel ratio compensation signal should be corrected in accordance with the deviation of the measured voltage across the terminals, of the battery, because the voltage level of the air-fuel ratio compensation signal depends on this voltage of the battery 28.

In FIGS. 2 and 3, the characteristics of the air-fuel ratio compensation signal are illustrated in order to explain in detail the aforementioned adjusting operation of the basic air-fuel ratio.

Referring to FIG. 2, which shows the characteristics of the air-fuel ratio compensation signal wherein the desired value of the basic air-fuel ratio to be adjusted is equal to the stoichiometric air-fuel ratio, in other words, excess air ratio ($\lambda$) is equal to 1.0, the reference letter a shows the voltage level of the air-fuel ratio compensation signal while the feedback control operation is being stopped. This voltage level a corresponds to the voltage level of the air-fuel ratio compensation signal while no compensation is being carried out by the feedback control operation, in other words, when the basic air-fuel ratio is equal to the stoichiometric air-fuel ratio.

During the operation of the feedback control, when the voltage level of the air-fuel ratio compensation signal corresponds to a level of b' as shown in FIG. 2 and the average voltage level thereof, which is indicated by the voltage meter 29, corresponds therefore to a level of b, as also shown in FIG. 2, the basic air-fuel ratio of the engine is on the lean side of the desired basic air-fuel ratio. In this case, the bypass screw 16 should be adjusted for decreasing the amount of air fed through the bypass passage until the indicated average voltage level corresponds to the voltage level of a.

When the voltage level of the air-fuel ratio compensation signal corresponds to a level of c' and the average voltage level thereof, which is indicated by the voltage meter 29, corresponds therefore to a level of c, as shown in FIG. 2, the basic air-fuel ratio of the engine is on the rich side of the desired basic air-fuel ratio. In this case, the bypass screw 16 should be adjusted so as to cause the amount of air fed through the bypass passage to increase until the indicated average voltage level corresponds to the voltage level of a.

Referring to FIG. 3, which shows the characteristics wherein the desired value of the basic air-fuel ratio to be adjusted is different from the stoichiometric air-fuel ratio, for example, the desired value is 1.05 ($\lambda=1.05$), the reference letter a shows the voltage level of the air-fuel ratio compensation signal while the feedback control operation is being stopped and also when the basic air-fuel ratio is equal to the stoichiometric air-fuel ratio, the reference letter d shows the voltage level of the air-fuel ratio compensation signal when the basic air-fuel ratio is equal to the desired value. This level d is, in this case, higher than the level a by a value of $\Delta V$. Therefore, during the adjustment, the bypass screw 16 should be adjusted to cause the average voltage level of the air-fuel ratio compensation signal b or c, which is indicated by the voltage meter 29, to become equal to the level d which is higher by a value of $\Delta V$ than the measured level a of the compensation signal while the feedback control operation is being stopped.

In the case wherein the feedback control operation is being stopped during the adjustment, the adjusting procedure is performed by forcibly actuating the feedback control operation. As an example of the above case, when the feedback control operation is stopped by the application of a high level signal, which indicates that the throttle valve 13 is closed, from the throttle position switch 15, the feedback control operation can be forcibly started again by closing the third switch 27 of the basic air-fuel ratio adjustment device 24.

FIG. 4 is a circuit diagram of the basic air-fuel ratio adjustment device 24' of another embodiment according to the present invention. In this device 24', a fixed contact 26*b* of the second switch 26 which is the same as that shown in FIG. 1 is connected to the junction point of the dividing resistors 30 and 31, which are connected to each other in series. The dividing resistors 30 and 31 are connected between an input terminal 32, which may be connected to the battery 28 (FIG. 1), and the ground.

Generally, in the feedback control circuits for compensating an error of the air-fuel ratio, the voltage level of the air-fuel ratio compensation signal when the feedback control is stopped is set to a level which is proportional to the voltage of the terminal of a battery, such as to a level which is half of the level of the voltage across the terminals of the battery. Therefore, in the engine having the above-mentioned construction of the feedback control circuit for compensating an error of the air-fuel ratio, a voltage level corresponding to the level of the air-fuel ratio compensation signal while the feedback control operation is being stopped can be easily obtained by measuring the voltage level at the junction point of the dividing resistors 30 and 31 of the device 24' according to the present embodiment of the invention. In this device 24', the first switch 25 for stopping the feedback control operation, as shown in FIG. 1, is unnecessary. The following procedure for adjusting the basic air-fuel ratio of this embodiment is the same as that of the aforementioned embodiment.

In the foregoing embodiments, the basic air-fuel ratio adjustment method and the apparatus according to the present invention are applied to the internal combustion engine having an EFI device. However, in other embodiment according to the present invention, the engine may be one having a carburetor for setting the basic air-fuel ratio instead of the fuel injection valve of the foregoing embodiments. Furthermore, in some embodiments according to the present invention, the air-fuel ratio compensation signal may be used for compensating an error of the air-fuel ratio by increasing or decreasing the amount of secondary air fed into the engine.

As is apparent from the foregoing description, according to the present invention, a signal level corresponding to the level of the air-fuel ratio compensation signal while the feedback control operation for compensating an error of the air-fuel ratio is being stopped is measured and then the basic air-fuel ratio is adjusted by measuring the average level of the air-fuel ratio compensation signal while the feedback control is in operation and by comparing this measured average level with the measured level when the feedback operation is stopped. Accordingly, the adjusting operation of the basic air-fuel ratio can be very easily performed. Furthermore, a high accuracy of the adjustment can be easily obtained.

As many widely different embodiments of the present invention may be constructed without departing from the spirit and scope of the present invention, it should be understood that the present invention is not limited to the specific embodiments described in this specification, except as defined in the appended claims.

What is claimed is:

1. A basic air-fuel ratio adjustment method for an internal combustion engine having means for detecting the air-fuel ratio of an air-fuel mixture supplied to said engine, means for generating an air-fuel ratio compensation signal having a level which increases or decreases in accordance with the detected ratio, means for holding the level of said compensation signal at a level which is determined in accordance with a power supply voltage, during a specific operating condition where the air-fuel ratio feedback control operation is stopped, means for supplying said engine with an air-fuel mixture of a ratio corrected in accordance with the level of said air-fuel compensation signal, so that the air-fuel ratio of the supplied air-fuel mixture becomes equal to a desired value, and means for presetting a basic air-fuel ratio which is equal to a ratio of the air-fuel mixture supplied to the engine when the air-fuel ratio feedback control operation is stopped, said method comprising the steps of:

measuring a signal level corresponding to the level of said air-fuel ratio compensation signal when the air-fuel ratio feedback control operation is stopped;

then, measuring the average level of said air-fuel ratio compensation signal when the feedback control operation is being carried out; and adjusting said presetting means so that the difference between said measured level when the feed back control operation is stopped and said measured average level when the feedback control operation is carried out becomes equal to a predetermined value.

2. A basic air-fuel ratio adjustment method as claimed in claim 1, wherein said first measuring step includes a step of measuring the level of said air-fuel ratio compensation signal when said feedback control operation is stopped.

3. A basic air-fuel ratio adjustment method as claimed in claim 1, wherein said second measuring step includes a step of measuring a level proportional to a power supply voltage of said engine.

4. A basic air-fuel ratio adjustment method as claimed in claim 2 or 3, wherein said step of adjusting said presetting means includes a step of adjusting said presetting means so that said difference becomes equal to zero.

5. A basic air-fuel ratio adjustment method as claimed in claim 1, wherein said method further comprises a step of measuring the level of a power supply voltage of said engine during said operations for measuring said air-fuel ratio compensation signal levels, and a step of adjusting said levels of said air-fuel ratio compensation signals in accordance with said measured level of said power supply voltage.

6. A basic air-fuel ratio adjustment apparatus for an internal combustion engine having means for detecting the air-fuel ratio of an air-fuel mixture supplied to said engine, means for generating an air-fuel ratio compensation signal having a level which increases or decreases in accordance with the detected ratio, means for holding the level of said compensation signal at a level which is determined in accordance with a power supply voltage during a specific operating condition where the air-fuel ratio feedback control operation is stopped, means for supplying said engine with an air-fuel mixture of a ratio corrected in accordance with the level of said air-fuel compensation signal, so that the air-fuel ratio of the supplied air-fuel mixture becomes equal to a desired value, and means for presetting a basic air-fuel ratio which is equal to a ratio of the air-fuel mixture supplied to the engine when the air-fuel ratio feedback control operation is stopped, said apparatus comprising:

first measuring means for measuring a signal level corresponding to the level of said air-fuel ratio compensation signal when the air-fuel ratio feedback control operation is stopped;

second measuring means for measuring the average level of said air-fuel ratio compensation signal when the feedback control operation is being carried out; and means for adjusting said presetting means so that the difference between said measured level when the feedback control operation is stopped and said measured average level when the feedback control operation is carried out becomes equal to a predetermined value.

7. A basic air-fuel ratio adjustment apparatus as claimed in claim 6, wherein said first measuring means includes means for measuring the level of said air-fuel ratio compensation signal when said feedback control operation is stopped, and a switching means for forcibly stopping said feedback control operation.

8. A basic air-fuel ratio adjustment apparatus as claimed in claim 7, wherein said switching means is connected between the output terminal of said air-fuel ratio detecting means and an earth terminal of said engine.

9. A basic air-fuel ratio adjustment apparatus as claimed in claim 6, wherein said second measuring means includes means for measuring a level proportional to a power supply voltage of said engine.

10. A basic air-fuel ratio adjustment apparatus as claimed in claim 6, wherein said engine has a throttle valve and an idling position detecting circuit for generating a high level signal which causes said feedback control operation to stop when said throttle valve is in the idling position, wherein said apparatus further includes a switching means connected between an output terminal of said idling position detecting circuit and an earth terminal of said engine.

* * * * *